US008752375B2

(12) United States Patent
Berchowitz

(10) Patent No.: US 8,752,375 B2
(45) Date of Patent: Jun. 17, 2014

(54) FREE-PISTON STIRLING MACHINE IN AN OPPOSED PISTON GAMMA CONFIGURATION HAVING IMPROVED STABILITY, EFFICIENCY AND CONTROL

(75) Inventor: David M. Berchowitz, Athens, OH (US)

(73) Assignee: Global Cooling, Inc., Athens, OH (US)

( * ) Notice: Subject to any disclaimer, the term of this patent is extended or adjusted under 35 U.S.C. 154(b) by 192 days.

(21) Appl. No.: 13/210,704

(22) Filed: Aug. 16, 2011

(65) Prior Publication Data

US 2013/0042607 A1 Feb. 21, 2013

(51) Int. Cl.

| | |
|---|---|
| ***F02G 1/044*** | (2006.01) |
| ***F02G 1/045*** | (2006.01) |
| ***F02G 1/043*** | (2006.01) |
| ***F25B 9/14*** | (2006.01) |

(52) U.S. Cl.
USPC ..... 60/520; 60/518; 60/519; 62/6

(58) Field of Classification Search
USPC ..... 60/517–526; 62/6
See application file for complete search history.

(56) References Cited

U.S. PATENT DOCUMENTS

| | | | | |
|---|---|---|---|---|
| 4,397,155 | A * | 8/1983 | Davey | 62/6 |
| 4,458,489 | A | 7/1984 | Walsh | |
| 4,602,174 | A | 7/1986 | Redlich | |
| 4,967,558 | A * | 11/1990 | Emigh et al. | 60/520 |
| 5,385,021 | A * | 1/1995 | Beale | 62/6 |
| 6,226,990 | B1 | 5/2001 | Conrad | |
| 6,701,721 | B1 | 3/2004 | Berchowitz | |
| 7,171,811 | B1 | 2/2007 | Berchowitz et al. | |
| 7,200,994 | B2 | 4/2007 | Chertok | |
| 2007/0052508 | A1 * | 3/2007 | Tanaka | 335/220 |
| 2009/0094977 | A1 * | 4/2009 | Hill | 60/520 |
| 2011/0005220 | A1 | 1/2011 | Berchowitz | |
| 2011/0095542 | A1 | 4/2011 | Berchowitz | |

* cited by examiner

*Primary Examiner* — Kenneth Bomberg
*Assistant Examiner* — Deming Wan
(74) *Attorney, Agent, or Firm* — Frank H. Foster; Kremblas & Foster

(57) ABSTRACT

An opposed piston gamma type Stirling machine has its displacer driven by a linear electromagnetic transducer that is drivingly linked to the displacer and is located on the opposite side of the power piston's axis of reciprocation from the displacer preferably in the bounce space. The linear transducer is controlled by an electronic control as a function of sensed inputs of Stirling machine operating parameters. In addition to allowing improvements in stability and efficiency, such a Stirling machine operated as a cooler/heat pump can also be controlled so that its displacer can be driven at (1) a phase angle that pumps heat in one direction through the machine or (2) at another phase angle that pumps heat in the opposite direction through the machine and allows selectively switching between the heat pumping directions.

12 Claims, 6 Drawing Sheets

Fig. 1
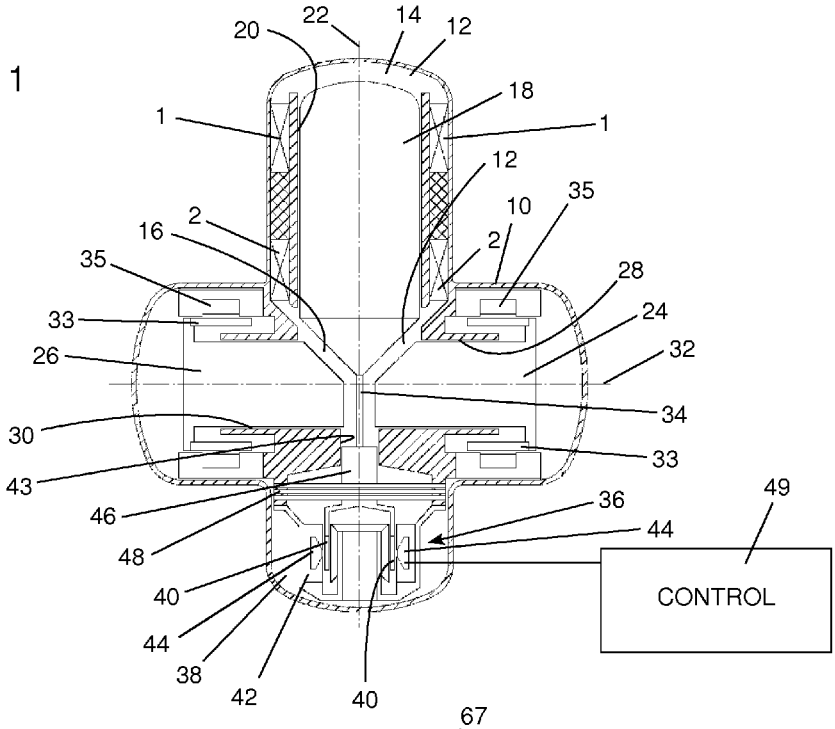
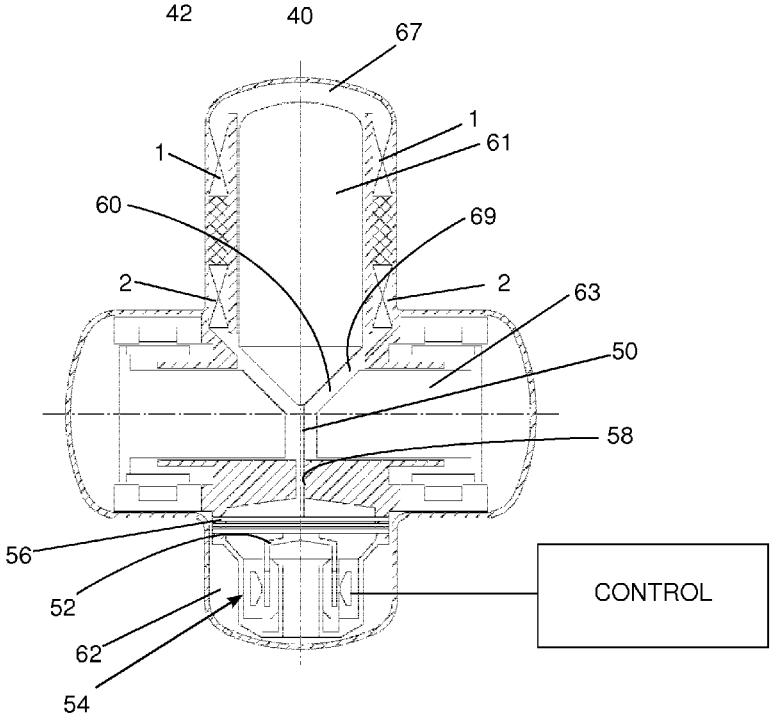
Fig. 2

Fig. 3
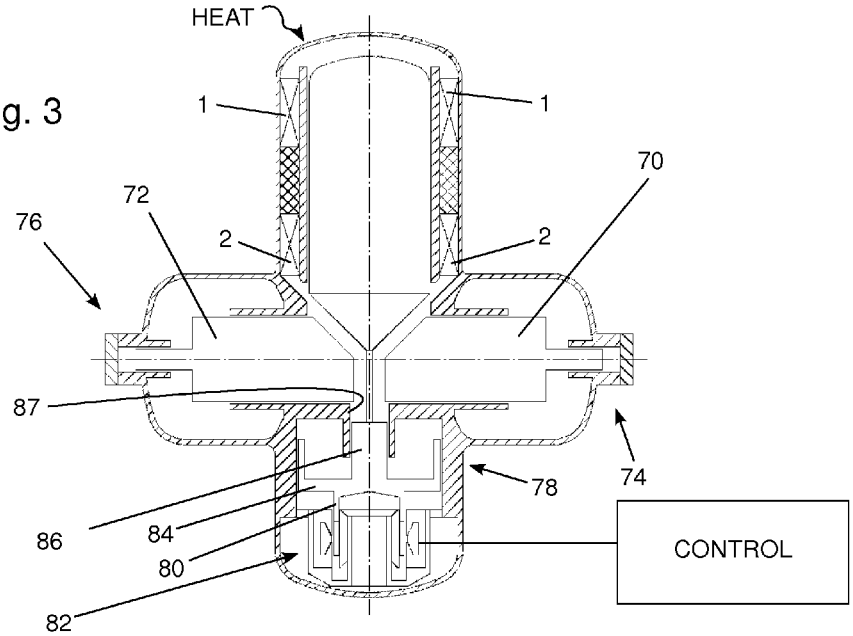
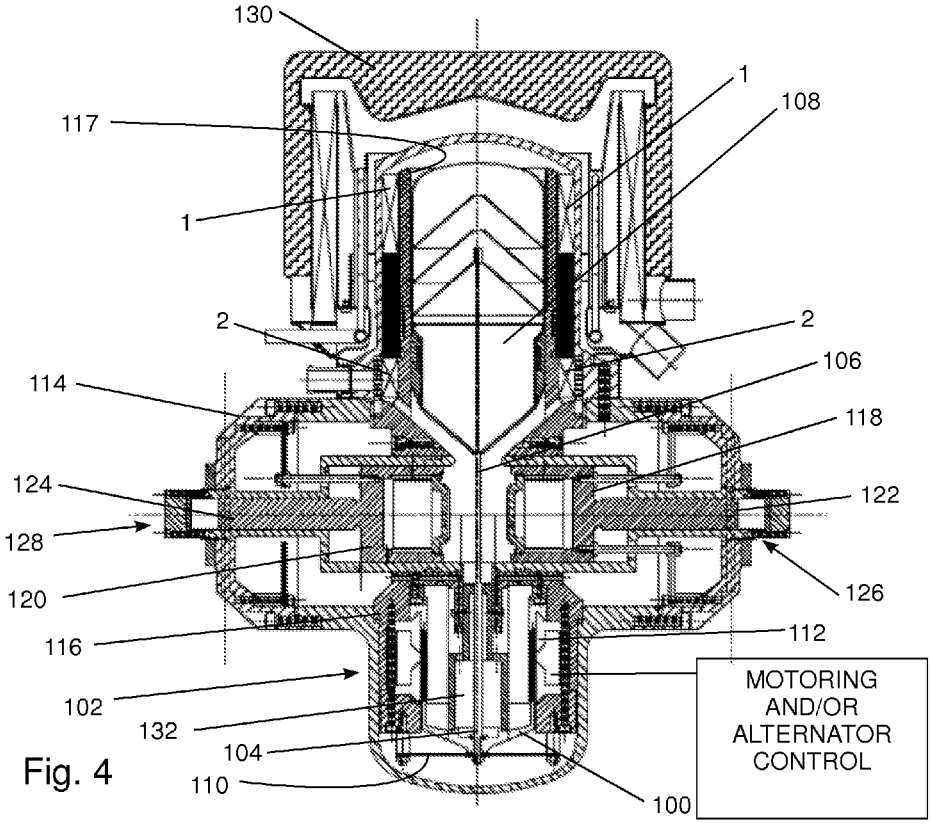
Fig. 4

FREE-PISTON STIRLING MACHINE IN AN OPPOSED PISTON GAMMA CONFIGURATION HAVING IMPROVED STABILITY, EFFICIENCY AND CONTROL

BACKGROUND OF THE INVENTION

This invention relates generally to free-piston Stirling engines, heat pumps and coolers and more particularly relates to improving the performance of a gamma configured free-piston Stirling machine with opposed power pistons by providing improved control of its output in a manner that can be more precisely adapted to and optimized for the operating conditions encountered by the Stirling machine. In the invention, a displacer has a connecting rod extending past the power pistons to an electromagnetic linear transducer. The linear transducer controls the amplitude and phase of the displacer's reciprocation allowing the linear transducer to control a Stirling cooler/heat pump in a manner that delivers a maximum rate of heat transfer or maximum efficiency over the entire range of operating temperatures and to control a Stirling engine in a manner that matches the power output of the engine to the load power demand while maximizing efficiency and stability over the entire range of operating temperatures and within the limits of the machine.

Fundamental Stirling Principles

As well known in the art, in a Stirling machine a working gas is confined in a working space that includes an expansion space and a compression space. The working gas is alternately expanded and compressed in order to either do mechanical work or to pump heat from the expansion space to the compression space. The working gas is cyclically shuttled between the compression space and the expansion space as a result of the motion of one or more power pistons and, in some machines a displacer. The compression space and the expansion space are connected in fluid communication through a heat accepter, a regenerator and a heat rejecter. The shuttling cyclically changes the relative proportion of working gas in each space. Gas that is in the expansion space, and gas that is flowing into the expansion space through a first heat exchanger (the accepter) between the regenerator and the expansion space, accepts heat from surrounding surfaces. Gas that is in the compression space, and gas that is flowing into the compression space through a second heat exchanger (the rejecter) between the regenerator and the compression space, rejects heat to surrounding surfaces. In the embodiments of the invention that are illustrated in FIGS. 1-4, the first heat exchanger has the reference numeral 1 and the second heat exchanger has the reference numeral 2. The gas pressure is essentially the same in the entire work space at any instant of time because the expansion and compression spaces are interconnected through a path having a relatively low flow resistance. However, the pressure of the working gas in the work space as a whole varies cyclically and periodically. When most of the working gas is in the compression space, heat is rejected from the gas. When most of the working gas is in the expansion space, the gas accepts heat. This is true whether the machine is working as a heat pump or as an engine. The only requirement to differentiate between work produced or heat pumped, is the temperature at which the expansion process is carried out. If this expansion process temperature is higher than the temperature of the compression space, then the machine is inclined to produce work so it can function as an engine and if this expansion process temperature is lower than the compression space temperature, then the machine will pump heat from a cold source to a warm heat sink.

As also well known in the art, there are three principal configurations of Stirling machines. The alpha configuration has at least two pistons in separate cylinders and the expansion space bounded by each piston is connected through a regenerator to a compression space bounded by another piston in another cylinder. These connections are arranged in a series loop connecting the expansion and compression spaces of multiple cylinders. The beta configuration has a single power piston, usually referred to simply as the piston, arranged within the same or a concentric cylinder as a displacer piston, usually referred to a simply a displacer. A gamma Stirling machine also has a displacer and at least one power piston but the piston is mounted in a separate cylinder alongside and sufficiently far from the axis of the displacer cylinder that the displacer and piston will not collide.

Stirling machines can operate in either of two modes to provide either: (1) an engine having its piston or pistons driven by applying an external source of heat energy to the expansion space and transferring heat away from the compression space and therefore capable of being a prime mover for a mechanical load, or (2) a heat pump having the power piston or pistons (and sometimes a displacer) cyclically driven by a prime mover for pumping heat from the expansion space to the compression space and therefore capable of pumping heat energy from a cooler mass to a warmer mass. The heat pump mode permits Stirling machines to be used for cooling an object in thermal connection to its expansion space, including to cryogenic temperatures, or for heating an object, such as a home heating heat exchanger, in thermal connection to its compression space. Therefore, the term Stirling "machine" is used generically to include both Stirling engines and Stirling heat pumps.

A Stirling machine that pumps heat from its expansion space is sometimes referred to as a cooler when its purpose is to cool a mass in thermal connection to its expansion space and sometimes is referred to as a heat pump when it purpose is to heat a mass in thermal connection to its compression space. They are fundamentally the same machine to which different terminology is applied Both "pump" (transfer) heat from an expansion space to a compression space. Working gas expansion in the expansion space absorbs heat from the interior walls surrounding the expansion space of the Stirling machine and working gas compression in the compression space rejects heat into the interior walls of the Stirling machine surrounding the compression space. Consequently, the terms cooler/heat pump, cooler and heat pump can be used equivalently when applied to fundamental machines.

Similarly a Stirling engine and a Stirling cooler/heat pump are basically the same power transducer structures capable of transducing power in either direction between two types of power, mechanical and thermal.

Problem to Which the Invention is Directed

As is well known, free-piston Stirling engines and coolers (FPSE/C) of the beta and gamma configurations employ two major moving parts, viz. the displacer and the piston or pistons as in opposed piston gamma configurations. The internally generated pressure variations of the working gas drives the displacer. This requires that the forces on the displacer be very carefully balanced so as to obtain the proper dynamic operation of the displacer. These forces consist of the spring forces, the inertia force, the pressure drop force and the differential pressure force across the displacer rod. The motion of the displacer directly controls the function of the machine, whether the machine is a cooler/heat pump, in which case the controlled function is the thermal lift, or the machine is an engine (prime mover), in which case the controlled function is the delivered mechanical power. The degree of lift or delivered power is determined by the relative phase angle between the displacer and piston motions and the amplitude of the motions of the displacer.

The essential problems and difficulties with driving the displacer with gas pressures alone are that:

a. In heat pumps, the maximum possible efficiency (or coefficient of performance) is not maintained at all operating conditions. The machine will therefore have increasingly compromised performance depending on how far the operating condition is from the design point.

b. In prime movers or engines, the problem is more severe in that it is often the case that stable operation with a changing load is only possible with an electronic controller between the load and the engine. This electronic controller needs a power capability at least as high as the maximum power delivered and a response time at least greater than the response time of the engine. There is also the problem of extracting the maximum efficiency at different operating conditions as in point (a).

It is therefore an object and feature of the invention to provide full but independent displacer control while minimizing added mass and dead volume in an opposed piston gamma configuration.

A further object of the invention is to provide an improved controllable free-piston Stirling configuration for opposed piston gamma type engines to control the displacer motions in order to change the power curve of the engine so that a variable but stable operating point is always established by assuring that the engine power curve grows with piston amplitude slower than the load curve does.

A further object of the invention is to provide an improved controllable free-piston Stirling configuration for opposed piston gamma type engines and heat pumps whereby the displacer motions are adjusted in order to maximize the efficiency or coefficient of performance depending on whether the device is operating as an engine or a heat pump.

A still further object of the invention is to provide an improved controllable free-piston Stirling configuration for opposed piston gamma type heat pumps in which the displacer phase may be reversed in order to pump heat in either direction through the machine.

BRIEF SUMMARY OF THE INVENTION

The invention is an improvement of an opposed piston gamma type Stirling machine and results in improved operating stability, optimization of efficiency or coefficient of performance and allows a Stirling cooler/heat pump to pump heat in either direction. The improvement is a linear electromagnetic transducer that is drivingly linked to the displacer, located on the opposite side of the power piston's axis of reciprocation from the displacer (preferably in any bounce space) and is controlled by an electronic control. The invention allows independent control of the displacer's amplitude and phase. The location of the linear transducer avoids the need for design compromises and modifications that would negatively affect the efficiency, cost and performance of the Stirling machine. The control of the displacer is independent in the sense that the displacer amplitude and phase can be whatever the designer wants so long as sufficient power is applied by the electromagnetic transducer to the displacer at an appropriate phase that a desired resultant amplitude and resultant phase will result. That is true whether the drive power of the electromagnetic transducer that is drivingly linked to the displacer is the sole source of displacer drive power or the displacer drive power is supplemented by simultaneous application of displacer drive power in the conventional manner. For a Stirling cooler/heat pump, the electronic control can also be capable of driving the displacer at (1) a phase angle that pumps heat in one direction through the machine or (2) at another phase angle that pumps heat in the opposite direction through the machine and also allows selectively switching between the heat pumping directions.

BRIEF DESCRIPTION OF THE SEVERAL VIEWS OF THE DRAWINGS

FIG. 1 is a diagrammatic view showing a first example of an embodiment of the invention.

FIG. 2 is a diagrammatic view showing a second example of an embodiment of the invention.

FIG. 3 is a diagrammatic view showing a third example of an embodiment of the invention.

FIG. 4 is a view in vertical cross section of a practical embodiment of the invention and showing an opposed piston gamma type Stirling engine directly driving the compressor of a heat pump.

Figure 5:
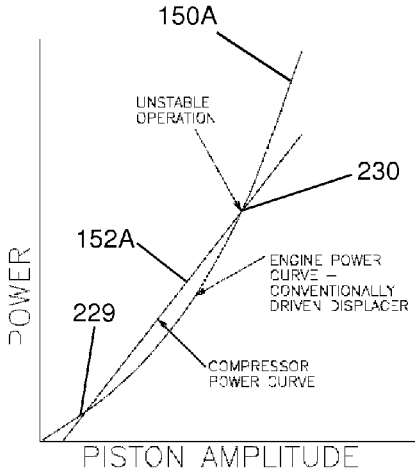
FIG. 5 is a graph of representative power curves for a Stirling engine driving a compressor according to prior art design and control.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Published U.S. patent application, Pub. No. US 2011/0005220 A1, Ser. No. 12/828,387, published Jan. 13, 2011 and having the identical inventor as the present invention, is hereby incorporated by reference. The present invention may be applied to multiple piston gamma arrangements disclosed in that US Patent application.

Terminology and Definitions

Although the terms used in this description are understood by those skilled in the art, it is desirable that some of them be briefly explained in order to facilitate understanding of the description and the invention.

"Electromagnetic linear transducers". As known in the art, both an electric motor and an alternator are the same basic device. They are electromagnetic transducers that have a stator, ordinarily having an armature winding, and a rotating or reciprocating member that includes magnets, usually permanent magnets. They convert power in either direction between electrical power and mechanical power. A motor/alternator structure can be mechanically driven by a prime mover to generate electrical power output or a motor/alternator can be driven by a source of alternating electrical power to operate as a motor providing a mechanical output.

Consequently, both a Stirling machine and a motor/alternator structure are energy transducers that can each be operated in either of two modes. They can be drivingly connected together with one operating as the prime mover and the other performing work, either generating electrical power or transferring heat.

"Resonating" means that a spring is linked or connected to a body and the spring and the mass of the body have characteristics that form a resonant system that has a resonant frequency. The spring constant, force constant or torsion coefficient of the spring is related to the total mass of a body so that they have a natural frequency of oscillation, either angular oscillation (for rotationally oscillating body) or linear (reciprocating) oscillation. The resonant frequency of the bodies in the invention is the operating frequency of the Stirling machine. When describing the oscillating motion of one or more bodies in a resonant system, the principal structure, such as the displacer, is sometimes referred to as being resonated. It should be understood, however, that the effective mass of a body in a resonant system includes the mass of all structures that are attached to and move with it. As known in the prior art, a resonant system is commonly used to balance the inertial forces of a displacer and other reciprocating bodies.

"Springs" are used in the present invention to resonate the oscillating and reciprocating masses. The term "spring" includes mechanical springs (such as coil springs, leaf springs, planar springs, spiral or involute springs), gas springs, such as formed by a piston having a face moving in a confined volume, electromagnetic springs and other springs as known in the prior art or a combination selected from them. Gas springs also include the working gas in the work space in a Stirling machine and, in some implementations, can also include the back space because the gas applies a spring force to a moving wall of a confined space as the volume of the space changes. As known to those in the art, generally a spring is a structure or a combination of structures that applies a force to two bodies that is proportional to the displacement of one body with respect to the other. The proportionality constant that relates the spring force to the displacement is referred to as the spring constant, force constant or torsion coefficient.

"Drive rod" and "connecting rod". A "connecting rod" connects two or more bodies so that they move together as a unit, usually with one body being driven through the connecting rod by another body. A "drive rod" in a Stirling machine is a rod that functions to cause a drive force to be applied to a displacer. Conventionally, a displacer is driven in reciprocation by the varying working gas pressure. A drive rod is connected to extend from the displacer through a mating cylindrical wall into a bounce space, sometime called a back space. The bounce space is a confined space that is not connected in communication with the working space. Consequently, the pressure in the bounce space does not vary as a result of working space pressure variations. The drive rod functions as a piston with the net driving force applied to that piston, and therefore to the displacer, being the result of the differential pressure applied to the cross sectional area of the drive rod in one direction by the gas in the working space and in the opposite direction by the gas in the bounce space. A drive rod can additionally function as a connecting rod as a result of its being connected to another body in addition to its extending through a cylindrical wall with differing pressures at opposite ends of the cylindrical wall. Consequently, the term "rod" can be used to refer to a rod that has only a connecting function or only a driving function or both functions. However, the term "rod" in this context of Stirling machines and the present invention, is not limited to a solid or a cylindrical rod. A connecting rod can be hollow and can have other cross-sectional shapes so long as it is capable of mechanically connecting two bodies. Although a cylindrical cross-sectional shape is by far the most practical for a drive rod, other configurations can be used.

FIG. 1 illustrates an opposed piston, gamma configured, free-piston Stirling machine having an outer casing 10 and a work space 12 within the casing 10. The work space 12 includes an expansion space and a compression space 14 and 16. However, as known to those skilled in the art, which of spaces 14 and 16 operates as an expansion space and which operates as a compression space is dependent upon the Stirling machine design and whether it is operating as an engine or cooler/heat pump and particularly upon the phasing of its displacer. Typically, the expansion space is located at an extremity of the machine as far as practical from the piston and other parts, such as space 14, because the expansion space typically experiences the most extreme temperatures.

A displacer 18 is mounted in a displacer cylinder 20 for reciprocation along a displacer axis of reciprocation 22 for cyclically varying the proportional distribution of a working gas between the expansion space and the compression space. A pair of power pistons 24 and 26 are mounted within piston cylinders 28 and 30 on opposite sides of the displacer axis of reciprocation 22 for reciprocation along a piston axis of reciprocation 32. Each piston is connected to an electromagnetic transducer that is not associated with the invention. This electromagnetic transducer is of conventional construction having circularly arranged magnets 33 that are fixed to the pistons 24 and 26 and reciprocate with the pistons 24 and 26 within a stator having armature windings 35 that are also arranged in a circular configuration around the magnets 33. The electromagnetic transducers that are connected to the pistons function as a linear motor for driving the Stirling machine and operating it as a cooler/heat pump or function as a linear alternator if the Stirling machine is operated as an engine.

In order to implement the invention, a displacer connecting rod 34 is fixed to and extends from the displacer 18 through the space between the pistons 24 and 26 and beyond the piston axis of reciprocation 32. An electromagnetic linear transducer 36 is drivingly connected to the displacer connecting rod 34 at a position that is on the opposite side of the piston axis of reciprocation 32 from the displacer 18 and outside all space occupied by the pistons during their reciprocation. Preferably, as illustrated, the linear transducer 36 is located in an extended bounce space 38. By locating the linear transducer 36 at the bounce space 38, implementation of the transducer 36 does not affect the work space or require an increase of dead space in the work space. That location also does not require any compromising tradeoffs or modifications of the structures near the regenerator, heat rejecting heat exchanger, heat accepting heat exchanger or the pistons. For simplicity, the linear transducer shown is of the moving magnet type such as illustrated in U.S. Pat. No. 4,602,174. The linear transducer 36 has magnets 40 that are connected to the end of the displacer connecting rod 34 for reciprocating with the connecting rod 34 and the displacer 18. The linear transducer 36 has a stator 42, with coil windings 44, that is attached to the casing 10 so that relative motion between the displacer 18 and the casing 10 will result in the same relative motion between the magnets 40 and the stator 42. The connecting rod 34 is connected to a piston 46 that reciprocates in its mating cylinder 43 for extracting power from the cycle as a result of the differential pressure applied to opposite ends of the piston 46 and delivering that power to the displacer in the manner well known in the art. In this manner, the piston 46 is a relatively short segment of drive rod that functions as a conventional drive rod but only supplements the drive power applied to drive the displacer 18 by the linear transducer 36. A conventional drive rod having the same diameter as the piston 46 along its entire length can be substituted for the connecting rod 34 and the piston 46. However, the illustrated arrangement with the smaller diameter connecting rod 34 is preferred because less space is occupied by the connecting rod between the reciprocating pistons 24 and 26 and therefore less dead space is included in the working space. Reduced dead space results in increased efficiency. In conventional free-piston Stirling machinery, the diameter of a drive rod is sized so that sufficient power is provided to the displacer in order to drive the displacer 18 with the appropriate amplitude and phase relative to the pistons 24 and 26. In the invention, the piston 46 is sized to provide supplemental displacer drive power, the remainder of the necessary power being provided by the electromagnetic linear transducer 36. The linear transducer 36 in the bounce space 38 provides the additional power needed for proper motion and in some cases may subtract power in order to alter the displacer dynamic motion for a particular outcome such as efficiency maximization or response to a load change on the output of an engine.

Planar mechanical springs 48 are utilized to balance the inertial forces of the displacer 18, as in the prior art. Typically, this spring has a spring constant so that the combined mass of the displacer, the rod and any other mass fixed to them is a resonant system at the nominal designed operating frequency of the Stirling machine. The presence of these springs 48 reduces the maximum force that needs to be delivered by the linear transducer 36 for driving the displacer. The practical result of keeping these forces low is that the linear transducer may be made smaller and can be operated with smaller currents for a given voltage.

An electronic control 49 provides power or extracts power as necessary from the linear transducer 36 and controls its motion in response to the demands of one or more outputs from the machine. The control 49 has an output connected to the stator coil 44 of the linear transducer 36 for controlling and adjusting at least one of the frequency, the phase and the amplitude of the displacer 18 as a function of parameters of machine operation that are sensed in real time and input to the control. As known in the art, this control is accomplished by controllably adjusting one or more of the amplitude, phase and frequency of the voltage applied to the stator coil 44 of the linear transducer 36. The sensed parameters used as the input or inputs for embodiments of the invention typically include one or more of several parameters depending upon the purposes of the embodiment. The typical sensed parameters include the amplitude of the pistons and their time of top-dead-center (TDC), displacer amplitude and its time of TDC and/or the temperature of an object, or container for an object, that is being cooled or heated by a Stirling cooler/heat pump. The prior art has many examples of apparatus for sensing in real time the value of these parameters. As known in the electronic control art, a set point input may also be an input to enable control for operating the machine at a set point by means of human control, such as for setting a desired temperature, pressure or voltage, or by means of another control system. The electronic control applies electrical power to the linear transducer for driving the displacer in reciprocation or absorbing electrical power from the transducer for reducing the amplitude of reciprocation of the displacer. Representative examples of electronic controls for embodiments of the invention are discussed in greater detail in a later portion of this description.

As is readily apparent, FIG. 1, FIG. 2, FIG. 3 and FIG. 4 have many structural components that are identical or nearly identical in multiple different figures. Most of these components are also known in the prior art and are illustrated to provide a context in which to illustrate the invention. The invention can be implemented in an extensive variety of other configurations of opposed piston, gamma configured, controllable, free-piston Stirling machines. When describing the embodiments of FIGS. 2, 3 and 4, structural components that were previously described in connection with a previously described figure will not be described again.

FIG. 2 illustrates an alternative embodiment of the invention. Because of the ease and convenience of providing motive power for driving the displacer with an electromagnetic linear transducer in accordance with the present invention, a drive rod and its supplementary drive of the displacer can be completely eliminated. In this case there would simply be a connecting rod 50 of smaller diameter than the typical drive rod and connected to the reciprocating magnet support 52 that carries the magnets of the linear transducer 54. The linear transducer 54 would have to be somewhat larger to accommodate the higher power required for it to be the sole driver of the displacer. Springs, such as the planar mechanical springs 56 would reduce the drive force required from the linear transducer 54 by balancing the inertial forces. This arrangement offers total power control (in the case of engines) or total thermal lift control (in the case of heat pumps) within the maximum capability of the machine. The connecting rod 50 should be a close-fit in its aft bearing which is a mating cylinder 58 in order to avoid excessive gas leakage between the working space 60 and the bounce space 62. However, the smaller diameter of the connecting rod 50 compared to a drive rod will result in either less leakage at the same clearance or relaxation of the tolerance of the fit for the same leakage. An example of an advantage of this implementation of the invention in power generation would be in solar applications where the control of the displacer amplitude primarily and phase secondarily would allow the heat input to occur at the highest allowable temperature thereby maintaining the highest possible efficiency. In micro-cogeneration applications, the linear transducer that drives the pistons can be grid coupled while the degree of power generation is handled by modulation of the displacer motions. An advantage for heat pumps is that total reversal of the heat pumping action is possible as described below.

FIG. 3 illustrates another example of the versatility of displacer control using the present invention. The Stirling machine is an engine shown with its pistons 70 and 72 directly driving compressors 74 and 76. A gas sprung displacer assembly 78 is used to balance the inertial forces of the displacer. Such a gas spring may be used with any of the embodiments and a planar mechanical spring may be used with this and other embodiments. The magnet-carrying reciprocating member 80 of a linear transducer 82 is connected to the gas spring piston 84 that forms part of a drive rod 86. The drive rod 86 extends through its mating cylinder 87 and provides supplemental power, the degree of which is dependent on the needs of the application.

FIG. 4 shows an embodiment of this invention in an actual design of a Stirling engine driven heat pump. The reciprocating member 100 of an electromagnetic linear transducer 102 is attached to a connecting rod 104 that in turn is connected through a connecting rod 106 (upwardly in the figure) to a displacer 108 and (downwardly in the figure) to a planar spring 110. A stator 112 of the linear transducer 102 is attached to the casing 114 by way of an extension 116 of the displacer cylinder 117, which is one piece that extends from the bottom of the machine to the displacer 108. The one piece that forms the displacer cylinder 117 and its extension 116 has laterally opposite cutouts to receive the cylinders for the opposed, Stirling machine pistons 118 and 120. Those pistons 118 and 120 are directly connected to the compressor pistons 122 and 124 of their respective compressors 126 and 128. A burner 130 provides heat energy to drive the engine in the conventional manner. A gas spring 132 and the planar mechanical spring 110 provide spring forces to counter the displacer inertia. The planar spring 110 also provides a centering force for the displacer assembly. The displacer control 134 provides an output of voltage and frequency that controls the displacer 108 in accordance with this invention to maintain a stable operating condition between power production by the Stirling engine and power consumption by the compressors.

Figure 6:
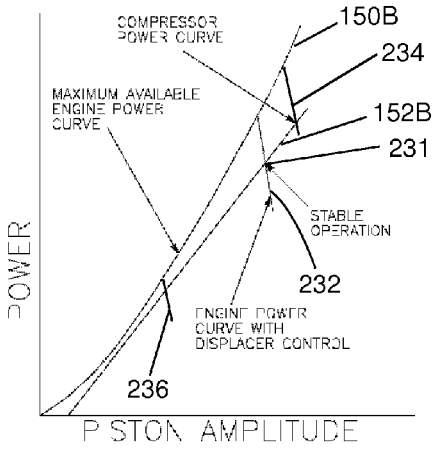
FIG. 6 is a graph of power curves for a Stirling engine driving a compressor according to principles of the invention.

FIGS. 5 and 6 illustrate a unique stability problem and its solution by the present invention when a Stirling engine drives a load, such as a compressor illustrated in FIG. 3, that has a linear power curve relating its power input to piston amplitude. Power produced by free-piston Stirling engines having a prior art passively driven displacer typically follows a square law curve, 150A and 150B, with respect to piston amplitude. Compressors, on the other hand, for given suction and discharge pressures, absorb power directly proportionally to piston amplitude as represented by linear characteristics 152A and 152B.

For stable operation two things are required, (a) the power generated by the Stirling engine prime mover must match the power absorbed by the load having the linear characteristic and (b) the power absorbed by that load must increase faster with increasing piston amplitude than power generated by the Stirling engine. In FIG. 5, operation at the first intersection point 229 of the load and engine power curves is stable because both criteria are met. The second intersection point 230 is unstable because, while the first criterion is met, the second is not. At the second intersection point 230, the engine power increases faster than the load with increasing piston amplitude. The conclusion drawn then is that a passively driven displacer free-piston engine will operate at the first intersection point but it will have no way to get to the second, more desirable higher power point. Indeed, if it got to the second intersection point, the system would be unstable with the result that the reciprocating components of the engine would increase their amplitude of reciprocation until they would strike its end stops with catastrophic results.

Referring to FIG. 6, with active displacer control as implemented by this invention, the engine can be operated along an engine power curve 232 that is arbitrarily below a maximum available engine power curve 150B defined by the maximum displacer amplitude and a piston amplitude varying from zero to maximum. Operating at the maximum power point 231 is simply a matter of controlling the motion of the displacer so that the power curve takes the form shown by 232. The control maintains the stability of the amplitude of reciprocation of the pistons and displacer at a steady state power operating point by varying the displacer's amplitude of reciprocation as a decreasing function of the power piston's amplitude of reciprocation. A steady state power operating condition exists when the load exhibits a constant load demand and therefore the control is attempting to maintain a constant engine power output at an operating point that matches the load power demand. Under this steady state condition, the control maintains stability at any selected operating point by reducing displacer amplitude in response to an increase in piston amplitude and increasing displacer amplitude in response to a decrease in piston amplitude. The decreasing function is illustrated as inversely proportional by the line 232 in FIG. 6, although other decreasing functions may be used. This meets the criteria for stable operation because the powers will match and the load power demand as a function of piston amplitude will grow faster than the engine power output as a function of piston amplitude. The inverse proportionality is reflected by the negative slope of the power curve 232. That function creates a negative feedback so that, if the engine piston amplitude increases, the displacer amplitude and therefore the piston amplitude will be reduced back to the equilibrium operating point and vice versa.

Other stable operating points for matching greater or lesser load power demands and Stirling engine outputs are now simply a matter of shifting the power curve 232 up or down the load curve, for example to provide power curves 234 and 236. The power curve 232 is shifted down the load curve, for example to 236, by reducing the displacer amplitude in order to reduce engine power output to a lower steady state power operating point and then controlling the displacer amplitude at the new operating point so that the displacer's amplitude of reciprocation is a decreasing function of the power piston's amplitude of reciprocation. Consequently, the engine power curve is shifted in this manner along a continuum that extends along the compressor power curve.

Figure 7:
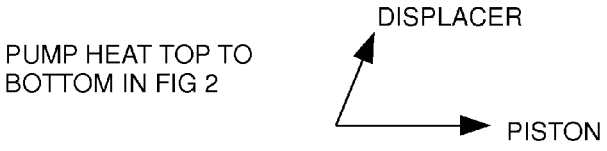
FIG. 7 is a phasor diagram illustrating the relative phase of the displacer and pistons of a Stirling cooler/heat pump operated to pump heat in a first direction in accordance with the method of the invention.
Figure 8:
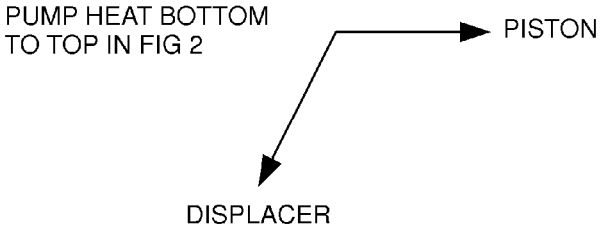
FIG. 8 is a phasor diagram illustrating the relative phase of the displacer and pistons of a Stirling cooler/heat pump operated in accordance with the method of the invention to pump heat in a direction opposite to the direction for FIG. 7.

FIGS. 7 and 8 are simple phasor diagrams illustrating the use of the invention to provide a Stirling cooler/heat pump that is capable of reversing its heat pumping direction. Because the invention allows independent control of the displacer's amplitude and phase, the displacer amplitude and phase with respect to the power pistons can be whatever the designer wants under all condition. In the case of heat pumping applications, this independent control of the displacer motions allows the same machine to completely reverse its operation by making the heat rejecter operate as a heat acceptor and the acceptor to operate as the rejecter. In other words, a linear transducer controlled displacer can be made to pump heat in either direction, depending on need. The same part or location of the machine can be switched between having heat transferred to it to provide a heat output and having heat transferred away from it to cool a mass. The switching between heating or cooling at the same location in the machine is accomplished by interchanging the functions of the expansion space and the compression space. Whether a space operates as an expansion space or a compression space is determined by the phase of the displacer. For example, if it is desired to pump heat from the top end to the bottom end of the embodiment of FIG. 2 (space 67 an expansion space and space 69 a compression space) the displacer 61 would run ahead of the pistons 63 and 65 with a phase of around 60° as illustrated in FIG. 7 (the pistons 63 and 65 run thermodynamically in phase but mechanically opposed). Now, if it is desired to pump heat in the reverse direction (space 67 a compression space and space 69 an expansion space), then the displacer would need to run behind the pistons with a phase of around minus −120° as illustrated in FIG. 8. This degree of control is simply not possible when driving the displacer passively.

This method of operating a Stirling cooler/heat pump and reversing the direction of pumping the heat is applicable to other Stirling machines utilizing a displacer. The method comprises driving the power piston in cyclic reciprocation with a prime mover and driving the displacer in cyclic reciprocation with an electromagnetic linear transducer driven at a selected phase angle relative to the phase angle of the power piston. At times the selected phase angle is controlled to be a first phase angle that causes a first space within the working space to operate as an expansion space for cooling an object and the second space to be a compression space for rejecting heat from the Stirling machine. At other times the selected phase is changed to a second phase angle that causes the first space to be a compression space for heating an object and a second space to be an expansion space for accepting heat. The first phase angle should be in the range from substantially 40° to substantially 70° and the second phase angle should be in the range from substantially −110° to substantially −140°. Most preferably, the first phase angle is substantially 60° and the second phase angle is substantially −120°. The linear transducer that drives the displacer is ordinarily driven by an alternating current and the method of controlling it further comprises adjusting the frequency and voltage of the alternating current.

Figure 9:
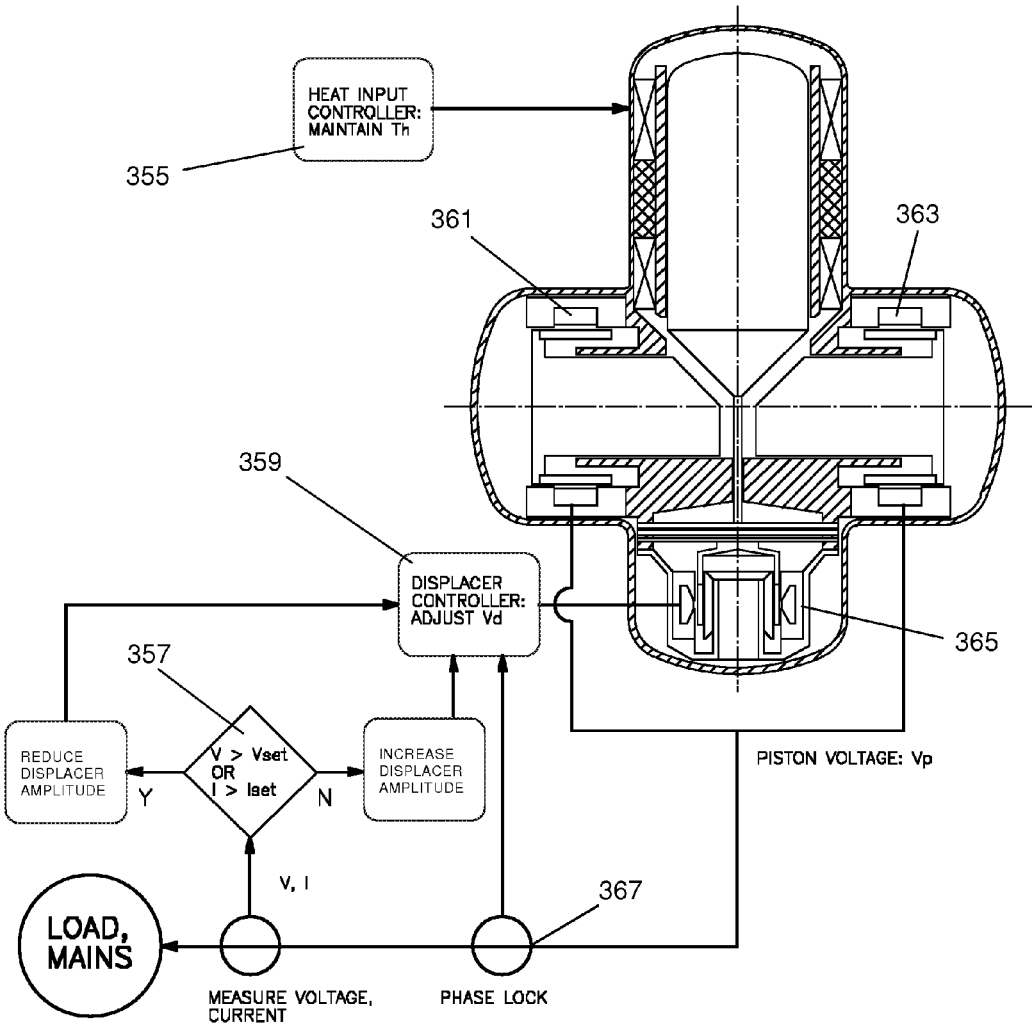
FIG. 9 is a schematic diagram illustrating a basic control for an engine driving electrical power into an electrical load or power grid mains.
Figure 10:
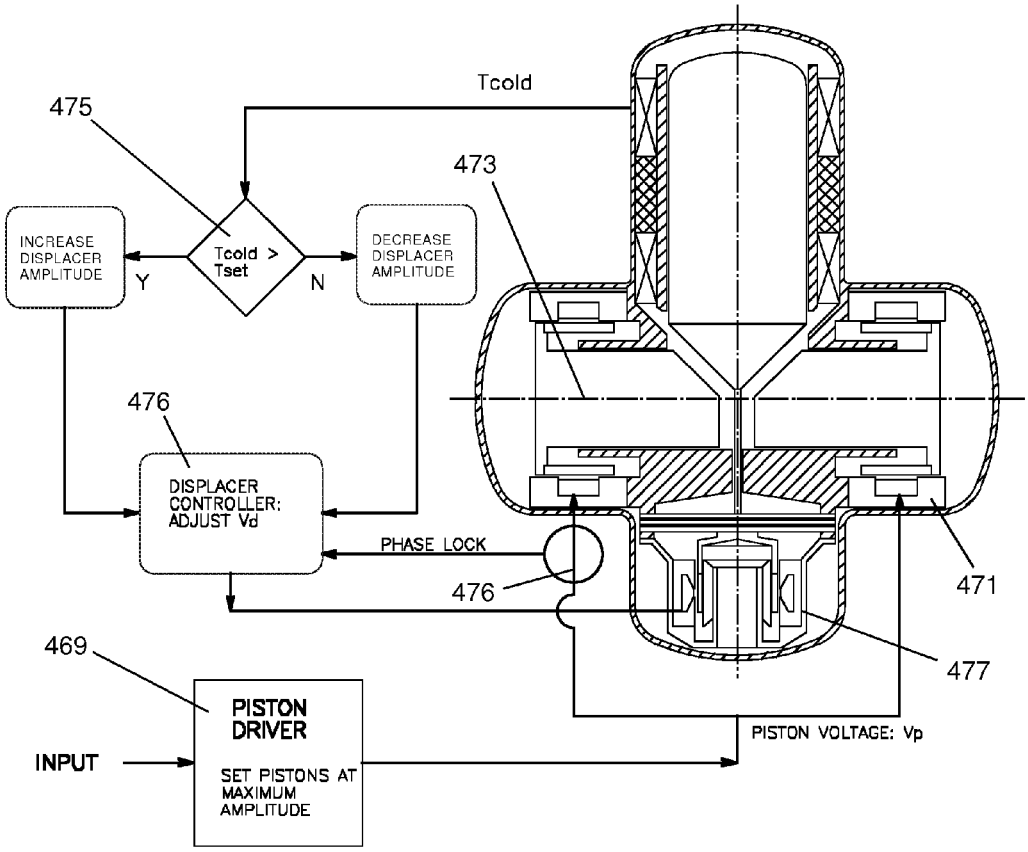
FIG. 10 is a schematic diagram illustrating basic control elements for a Stirling machine driven as a cooler/heat pump.
Figure 11:
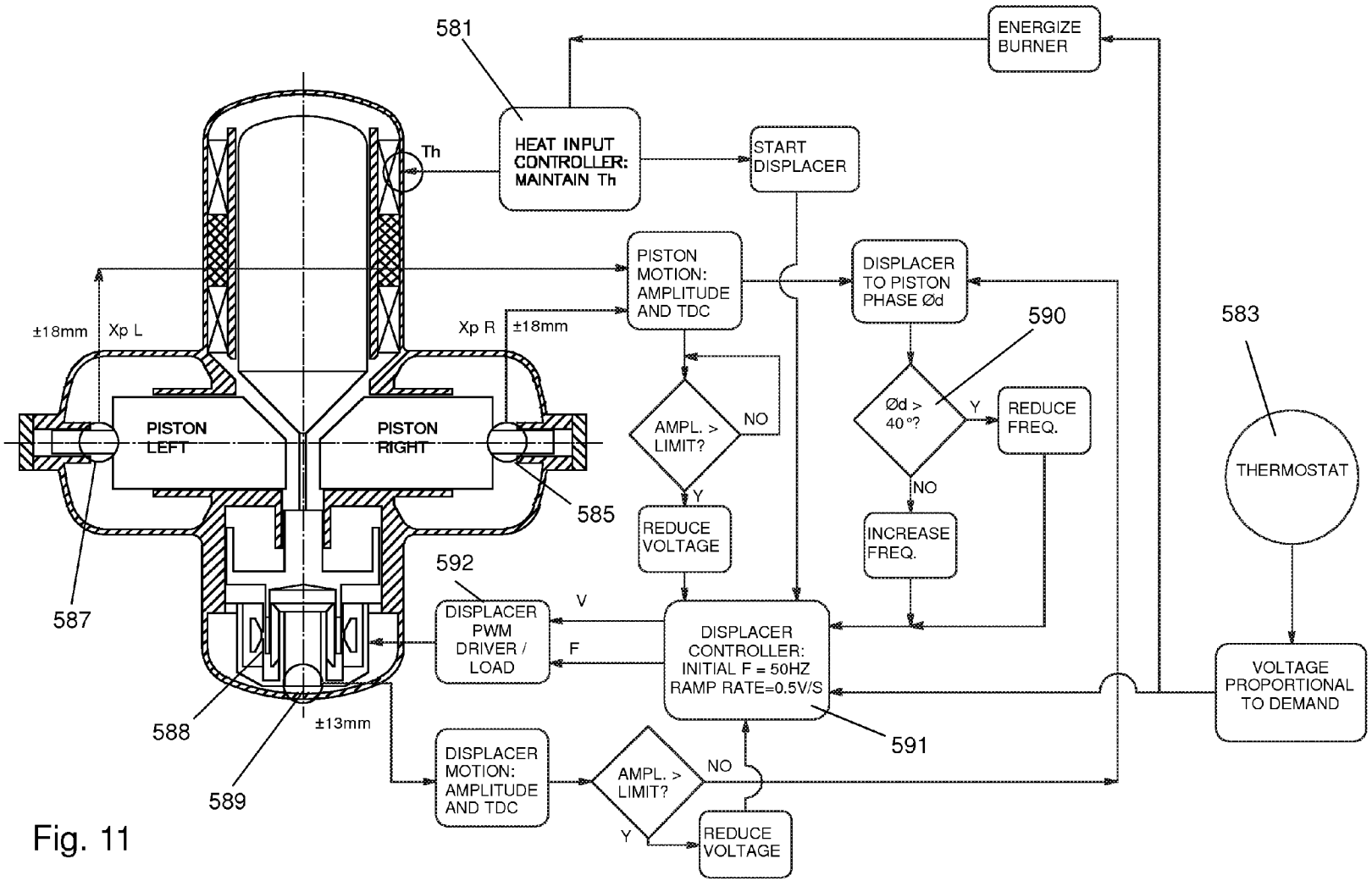
FIG. 11 is a schematic diagram illustrating basic control elements for a Stirling engine driving the compressors of a heat pump.

Electronic Controls that can be used with the present invention are illustrated by examples in FIGS. 9, 10 and 11. Of course other control principles that are known in the art may be adapted and incorporated into controls that control the linear transducer that drives the displacer in the present invention. Similarly, control principles for controlling the linear transducer that drives the displacer in the present invention can be adapted and incorporated into prior art control systems with an output for driving a linear transducer that drives a displacer.

In the present invention, the electromagnet linear transducer that is mechanically connected to the displacer will, in most applications, operate at times under some operating conditions as a linear motor that is driven by an alternating power source applied from its control to apply drive power to the displacer and maintain or increase the amplitude of reciprocation of the displacer. The same electromagnetic linear transducer in the embodiment can operate at other times under different operating conditions as a linear alternator to absorb power from the displacer and reduce its amplitude of reciprocation. In some embodiments the electromagnetic linear transducer that is mechanically connected to the displacer can be the sole source of power for driving the displacer in reciprocation and in other embodiments it can be a supplemental source of displacer drive power with the displacer also receiving drive power in the manner that is well known and conventional in the prior art.

FIG. 9 shows the basic elements of a displacer control for an opposed piston gamma Stirling engine applied to engines driving linear transducers as alternators and connected to an arbitrary electrical load or the mains. Current is limited to $I_{set}$ and voltage is limited to $V_{set}$ by controlling the displacer linear transducer voltage $V_d$. The displacer controller output is phase-locked to the voltage at the piston alternators. The head temperature is held at a constant temperature $T_h$ by a separate controller 355, which achieves this by adjusting the heat input. Though the details of the head temperature controller are not germane to this invention, it is clear that as power is modulated, the heat input will change in order to maintain a constant head temperature. The control logic 357 signals the displacer driver 359 to reduce the drive voltage $V_d$ that is applied to the linear transducer 365 if current or voltage exceeds the set values, $I_{set}$ and $V_{set}$ as measured at the electrically coupled piston alternators 361 and 363. When $V_d$ is reduced, the displacer amplitude will be reduced and the power generated at the piston alternators will be reduced. If either current or voltage is below the set values, then the displacer driver is signaled to increase the linear transducer drive voltage, $V_d$ thereby increasing the displacer amplitude and in turn generating more power at the pistons. The leading phase displacement of the displacer motions is locked to the piston motions by a phase-locked loop 367 that sets the phase of $V_d$ with respect to the measured voltage V. Two potential cases arise, viz., when the engine output is connected to the mains, as in micro-home cogeneration or if simply connected to an arbitrary electrical load. In the first case the voltage is more or less constant and control will generally be only effected on the current measurement. However, in the case of an open circuit, current will go to zero but in this case, the measured voltage will increase as the piston amplitudes increase due to unloading. When the piston alternator voltage exceeds $V_{set}$, the control logic will signal the displacer controller to reduce the displacer drive voltage until the power produced by the pistons just overcomes the internal losses of the machine. At this point the pistons will move at an amplitude that is just able to maintain $V_{set}$ but will produce no power. In the case of an arbitrary load on the piston alternators (i.e., not mains connected), both voltage and currents will signal the displacer controller. In this case, $V_{set}$ will establish the delivered voltage of the machine. Of course, as in any practical embodiment, there will be an error signal derived from the difference in the set points and measured values. The error signal will be the primary input to the displacer driver.

FIG. 10 shows the basic elements of a displacer control for an opposed piston gamma Stirling heat pump operating as a cooling machine. The input to the control logic 475 is the cold head temperature $T_{cold}$ which is controlled by adjusting the displacer linear transducer voltage $V_d$. The piston driver 469 provides a fixed input voltage and frequency (current source/alternating current driver) close to the resonant frequency of the piston linear motor assembles 471 and 473. This establishes the maximum amplitude for the piston linear motor assemblies. With zero displacer amplitude there is no lift (cooling power) and at maximum displacer amplitude and phase leading the pistons by about 40° to 70°, the lift is maximized. The control logic 475 signals the displacer driver 476 to increase the drive voltage $V_d$ to the displacer linear transducer 477 when the temperature $T_{cold}$ is warmer than $T_{set}$. As $T_{cold}$ approaches $T_{set}$, $V_d$ would be reduced according to an error signal until $T_{cold}$ is held constant at the desired temperature. The output of the displacer controller 476 locks the phase of the displacer to the piston drive voltage $V_p$ at the piston linear motors by a phase locked circuit 479. The phase locking circuit 479 may be made to adjust the displacer phase by setting it higher, say closer to 70°, for maximum cool down rate and reducing it once the target temperature is reached to closer to 40° to maximize the efficiency of the machine. This can be managed dynamically by changing the phase to minimize or maximize input. In this case, current to the piston linear alternators and current phase with respect to $V_p$ would be measured in order to determine power input. Where full reversal of the heat pumping direction is desired, the phase of $V_d$ must be increased to about 120° with respect to $V_p$. In this case the cold side would become the rejecter and would therefore reject heat. The control algorithm would therefore have to increase $V_d$ if $T_{cold}$ was colder than $T_{set}$ in order to provide the necessary heat to maintain the set-point temperature. Such applications are limited to controlling a fixed temperature space in environments where the ambient temperature may be above or below the $T_{set}$.

FIG. 11 shows the basic elements of a controller for displacer control of an opposed piston gamma engine that is directly driving compressors as may be used in a domestic heat pump (U.S. Pat. No. 6,701,721). In this embodiment, motion transducers are needed on the pistons and the displacer. Amplitude and phase information is extracted and provided to the displacer controller in order to maintain a favorable displacer phase (in this case 40°). Since the pistons run off-center in this application, top-dead-center (TDC) information is also needed in order to avoid collisions with the end-stops. The head temperature of the engine is kept constant by adjusting the heat input. The thermostat sets heat demand.

As explained previously, compressor loads are linear with respect to piston amplitude while the power produced by the Stirling engine is approximately according to the square of piston amplitude. For simplicity, the head temperature $T_h$ is assumed to be held constant by the heat input controller 581. Demand for heating (or cooling) is determined by a thermostat 583. Since there are no linear alternators or motors on the pistons, it is necessary to determine their motions by separate transducers 585 and 587, typically small position sensors. The displacer linear transducer 588, may be used as a position sensor or, alternatively, a separate position sensor 589 may be used. The control logic 590 provides inputs to the displacer controller 591 which, in turn, determines the inputs to the displacer driver/load 592. Once $T_h$ is sufficiently warm, the machine is started by the displacer controller 591 which provides a starting AC voltage and initial frequency to the displacer driver/load 592. The piston and displacer motion sensors determine the amplitudes and top-dead-centers (TDCs) of the moving parts. The control logic first tests whether the displacer or pistons have exceeded their maximum amplitudes and if so, signals the displacer controller to reduce the displacer drive voltage. If the amplitudes are within their limits, then the phase between the displacer and the pistons is determined (the pistons always move in phase, i.e., both move outwards or inwards as the case may be). If the phase is greater than the design point, typically around 40°, then the control logic signals the displacer controller to reduce the displacer driver frequency. If the phase is less than the design phase, then the control logic signals the displacer controller to increase the displacer driver frequency. Voltage to the displacer driver is controlled by the demand set by the thermostat 583. It is understood that the various rates required to increase or decrease the driver voltage and frequency are critical to the stability of the system. However, the essential requirement of providing sufficient power input to the compressors at all conditions is established by the displacer controller and control logic.

Advantages of the invention include: (1) improved control of the Stirling machine because of the independent control of the displacer that is made possible with the invention and therefore allows improved stability and efficiency; (2) a reduction in dead volume (dead space) which also improves efficiency; and (3) a mechanical topology or configuration that, because the linear magnetic transducer of the invention is placed on the opposite side of the piston axis of reciprocation from the displacer, allows more freedom to design and construct the transducer based upon its desired characteristics without compromises or constraints dictated by locating the transducer in other locations within the Stirling machine.

The invention is applicable to the gamma configuration of a Stirling machine wherein two or more pistons are arranged at right angles to the displacer motion. In order to minimize dead volume, the displacer drive area is provided on the displacer spring, which is mounted beyond the pistons so that the pistons do not have to accommodate the displacer drive or connecting rod as in conventional beta machines. This arrangement achieves substantial but incomplete balancing. The displacer remains unbalanced but is generally of low mass compared to the overall machine mass of the machine so that the residual motion is actually quite small and in many cases, acceptable.

The current invention provides an electromagnetic linear transducer attached to the aft end of the displacer located within the bounce space. Since this space is free to configure and has no significant effect on the performance of the machine, the linear transducer may be sized according to its own terms of efficiency and required power level while minimizing the moving mass without the compromises that would be needed if the linear transducer were positioned elsewhere in the Stirling machine.

Design compromises that are avoided include:

a. The linear transducer topology is not constrained by the shape and size of the displacer. The magnet diameter is determined solely by the design requirements for the linear transducer unaffected by the size or location of other machine components. By locating the transducer in a space where it can assume arbitrary topology limited only by performance requirements, optimal performance and size of the linear transducer are possible. For example, a designer may determine that, in a particular situation, only a small differential power is required for full and sufficient control. This determination would result in the need for only a small linear transducer that can easily be accommodated in the bounce-space region of the Stirling machine.

b. The linear transducer and especially its stator assembly is located away from the work space, the heat rejecter and the displacer, and therefore has no effect upon the design or positioning of those components and does not force the heat rejecter to be located away from its close interface with the regenerator and consequently introducing dead volume at a critical point in the machine that would reduce its performance.

c. There is no inner iron for carrying the magnetic flux of the linear transducer that moves with the displacer which would add mass that would add to the forces transmitted to the casing. Such forces would increase casing vibration, which would generally require a dynamic absorber or other means to reduce engine vibration to acceptable levels.

d. Because the linear transducer that drives the displacer is at the bounce space, thermodynamic compromises that would be necessary if it were positioned elsewhere are avoided.

e. None of the close-fitting precision components of the Stirling machine, such as the displacer, which is required to fit precisely within its cylinder, are compromised by requiring materials that are additionally suitable for electromechanical operation. For example, there is no need for those precision components to have materials for carrying magnetic fields or other materials with low magnetic permeability.

f. Alignment and retaining the sealing function of the displacer at the compression space is not made extremely difficult to achieve from the use of multiple materials (copper, transformer iron, aluminum and stainless steel, for example) that would cause differential expansion problems at higher or lower temperatures. Such use of multiple materials in the region of extremely tight clearance fits (around 25 μm on the displacer diameter), would lead to high cost.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A method for operating a Stirling cooler/heat pump having a casing containing a power piston and a displacer separating a work space into a first space in thermal connection to a first heat exchanger and a second space in thermal connection to a second heat exchanger, the method being for selectively pumping heat from the first heat exchanger to the second heat exchanger or alternatively from the second heat exchanger to the first heat exchanger for selectively heating or cooling an object in thermal connection to one of the heat exchangers, the method comprising:

(a) driving the power piston in cyclic reciprocation with a prime mover;

(b) driving the displacer in cyclic reciprocation with an electromagnetic linear transducer that is operatively connected between the displacer and the casing and driven at a selected phase angle relative to the phase angle of the power piston;

(c) at times changing the selected phase angle to a first phase angle such that the first space operates as an expansion space that accepts heat and the second space operates as a compression space that rejects heat, so that the Stirling cooler/heat pump pumps heat from the first heat exchanger to the second heat exchanger; and (d) at times changing the selected phase to a second phase angle such that the first space operates as a compression space that rejects heat and the second space operates as an expansion space that accepts heat, so that the Stirling cooler/heat pump pumps heat from the second heat exchanger to the first heat exchanger.

2. A method according to claim 1 wherein the first phase angle is in the range from substantially 40° to substantially 70° and the second phase angle is in the range from substantially −110° to substantially −140°.

3. A method according to claim 2 wherein the first phase angle is substantially 60° and the second phase angle is substantially −120°.

4. A method according to claim 1 wherein the linear transducer is driven by an alternating current and the method further comprises adjusting the frequency, phase and voltage of the alternating current.

5. An opposed piston, gamma configured, controllable, free-piston Stirling machine having an outer casing and a work space within the casing, the work space including an expansion space and a compression space, the Stirling machine comprising:

(a) a displacer mounted for reciprocation in a displacer cylinder along a displacer axis of reciprocation for cyclically varying the proportional distribution of a working gas between the expansion space and the compression space;

(b) at least two power pistons, the power pistons being mounted within piston cylinders positioned symmetrically around the displacer axis of reciprocation and adapted for reciprocation along piston axes of reciprocation;

(c) a displacer rod fixed to and extending from the displacer between the pistons and beyond the piston axes of reciprocation;

(d) an electromagnetic linear transducer operatively disposed between the displacer rod and the casing so as to drive or be driven by the displacer, the linear transducer being drivingly connected to the displacer rod at a position that is on the opposite side of the piston axes of reciprocation from the displacer and positioned outside all work space that is occupied by the pistons during their reciprocation; and (e) an electronic control having an output connected to the linear transducer and controlling the displacer amplitude of reciprocation as a function of sensed parameters of machine operation, the electronic control adapted to apply electrical power to the transducer for driving the displacer in reciprocation or absorb electrical power from the transducer for reducing the amplitude of reciprocation of the displacer by controllably adjusting one or more of the amplitude, phase and frequency of the voltage applied to the linear transducer.

6. A Stirling machine in accordance with claim 5, wherein the Stirling machine has a bounce space for the displacer and wherein the linear transducer is positioned in or adjacent the bounce space.

7. A Stirling machine in accordance with claim 6, wherein a spring applying its force along the axis of reciprocation of the displacer is linked between the displacer rod and the casing to balance the inertial forces of the reciprocating displacer.

8. A Stirling machine in accordance with claim 7, wherein the spring is a gas spring.

9. A Stirling machine in accordance with claim 7, wherein the spring is a planar spring.

10. A Stirling machine in accordance with claim 6, wherein the rod includes a drive rod extending through a mating cylinder interposed between the working space and the bounce space for extracting power from the cycle as a result of the differential of the pressures applied at opposite ends of the drive rod and thereby supplementing the displacer drive power of the linear electromagnetic transducer.

11. A Stirling machine in accordance with claim 6 wherein the rod is a connecting rod having no drive rod and all power driving the displacer in reciprocation is applied from the electromagnetic linear transducer.

12. A Stirling machine in accordance with claim 5, wherein the Stirling machine is an engine and the power pistons of the Stirling engine are drivingly connected to compressor pistons of a gas compressor and wherein, on a graph of power vs. piston amplitude, a characteristic power curve for the compressor is entirely at a lower piston amplitude than the characteristic curve for the maximum available engine power and wherein the control maintains the stability of the amplitude of reciprocation of the pistons and displacer at a steady state power operating point by varying the displacer's amplitude of reciprocation as a decreasing function of the power piston's amplitude of reciprocation.

* * * * *